US006314613B1

(12) United States Patent
Kuwayama

(10) Patent No.: US 6,314,613 B1
(45) Date of Patent: Nov. 13, 2001

(54) SUITCASE HANDLE FIXTURE CONSTRUCTION

(75) Inventor: Osamu Kuwayama, Aichi-ken (JP)

(73) Assignee: Sunco Luggage Co., Ltd., Aichi-ken (JP)

( * ) Notice: Subject to any disclaimer, the term of this patent is extended or adjusted under 35 U.S.C. 154(b) by 0 days.

(21) Appl. No.: 09/335,237

(22) Filed: Jun. 17, 1999

(51) Int. Cl.[7] ..... A47B 95/02
(52) U.S. Cl. ..... 16/113.1; 16/115
(58) Field of Search ..... 190/115, 18 A, 190/39; 16/115, 113.1

(56) References Cited

U.S. PATENT DOCUMENTS 4,792,025 * 12/1988 Thomas ..... 190/115
5,335,759 * 8/1994 Yeh ..... 190/115
5,428,868 * 7/1995 Safedeye et al. ..... 16/115
5,819,892 * 10/1998 Deliman et al. ..... 190/115
5,833,039 * 11/1998 Kotkins ..... 190/115
5,987,701 * 11/1999 Kuo ..... 16/115

* cited by examiner

*Primary Examiner*—Anthony Knight
*Assistant Examiner*—Enoch E Peavey
(74) *Attorney, Agent, or Firm*—Harrison & Egbert

(57) ABSTRACT

A retractable handle that can be freely moved in and out the storage tubes that are attached to the suitcase wall and in that the length of the tubes are shortened to a certain length determined by the length measurements of the suitcase wall.

The length of the storage tubes is set between ⅔ and ⅓ of the length measurements of the suitcase wall.

The synthetic resin suitcase wall and the mark that determines the position of the lower fixation part of the storage tubes are produced at the same time.

3 Claims, 4 Drawing Sheets

SUITCASE HANDLE FIXTURE CONSTRUCTION

TECHNICAL FIELD

The present invention is related to the improvement of the fixture construction of the retractable suitcase handle.

BACKGROUND ART

In FIG. 4 the outside of a common and normal suitcase 5 with a fixed retractable handle 60 is shown, where the handle 60 is halfway retracted.

The handle 60 is formed by two rods 61 of fixed length, whose upper tips are linked by a grip 62.

As for the handle 60, the suitcase 50 is divided into two parts, the body part 51 and the cover part 52, on the base wall α (suitcase wall) of cover part 52 the handle 60 is mounted as shown in FIG. 3.

The inside of the base wall α is as follows: in order to allow the rods 62 to be retracted freely, two storage tubes 63 are fitted parallel on the longitude, both the upper and lower ends of these tubes, are fixed onto the base wall α by upper fixture construction 64 and lower fixture construction 65 respectively.

Therefore as shown in FIG. 3, the storage tubes 63 usually extended to the whole length of the base wall.

But the body part 51 is naturally built strong enough to withstand some rough handling. Therefore the storage tubes 63, which are built into the base wall α do not really need to serve as a reinforcement of the suitcase 50.

Also for all users it is sufficient enough if the length of the rods 61 when they are completely extracted from the storage tubes 63, reaches half of the length of base wall α.

In short, in a normal suitcase 50, the length measurements of the storage tubes 63 are unnecessarily long.

Therefore this part, which is meaningless and raises the production costs and the weight of the suitcase and reduces its effective inside capacity.

So the aim of this invention is to reduce the length of the rods of the retractable handle and the storage tubes as much as possible to avoid unnecessary production costs and weight as well as the reduction of effective inside capacity and so we present this fixture construction suitcase handle.

In order to accomplish the above mentioned aim, the built in construction suitcase handle is characterized by the retractable that can easily be stored into the storage tubes which are attached to suitcase wall and that the length of the above mentioned storage tubes is shorter than the length of the above mentioned suitcase wall.

The length of the storage tubes should be between ⅔ and ⅓ of the length of the suitcase wall.

Also the place where the lower part of the storage tubes is fixed to the synthetic resin suitcase wall is best formed at the same time the wall is made.

DETAILED DESCRIPTION OF THE INVENTION

Below is an explanation of the shape of the suitcase according to this invention, referring to FIG. 1 and FIG. 2.

Figure 3:
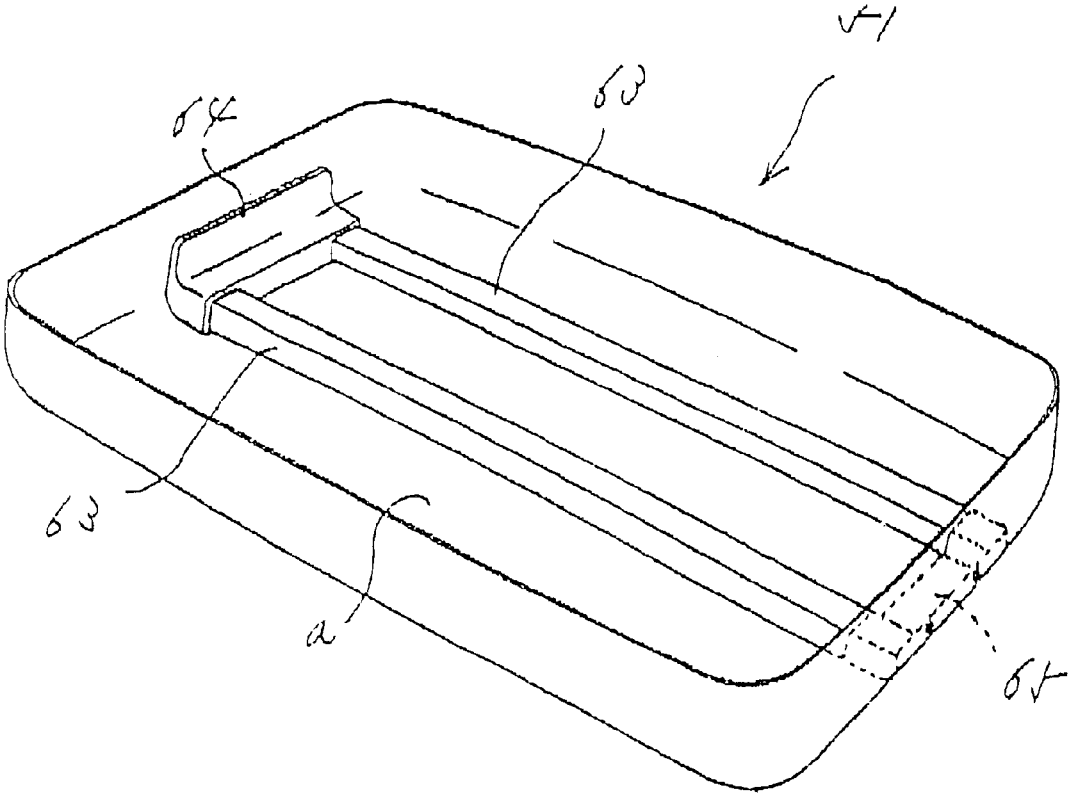
FIG.3 PRIOR ART
FIG. 3 is a side view from the inside of a conventional suitcase.
Figure 4:
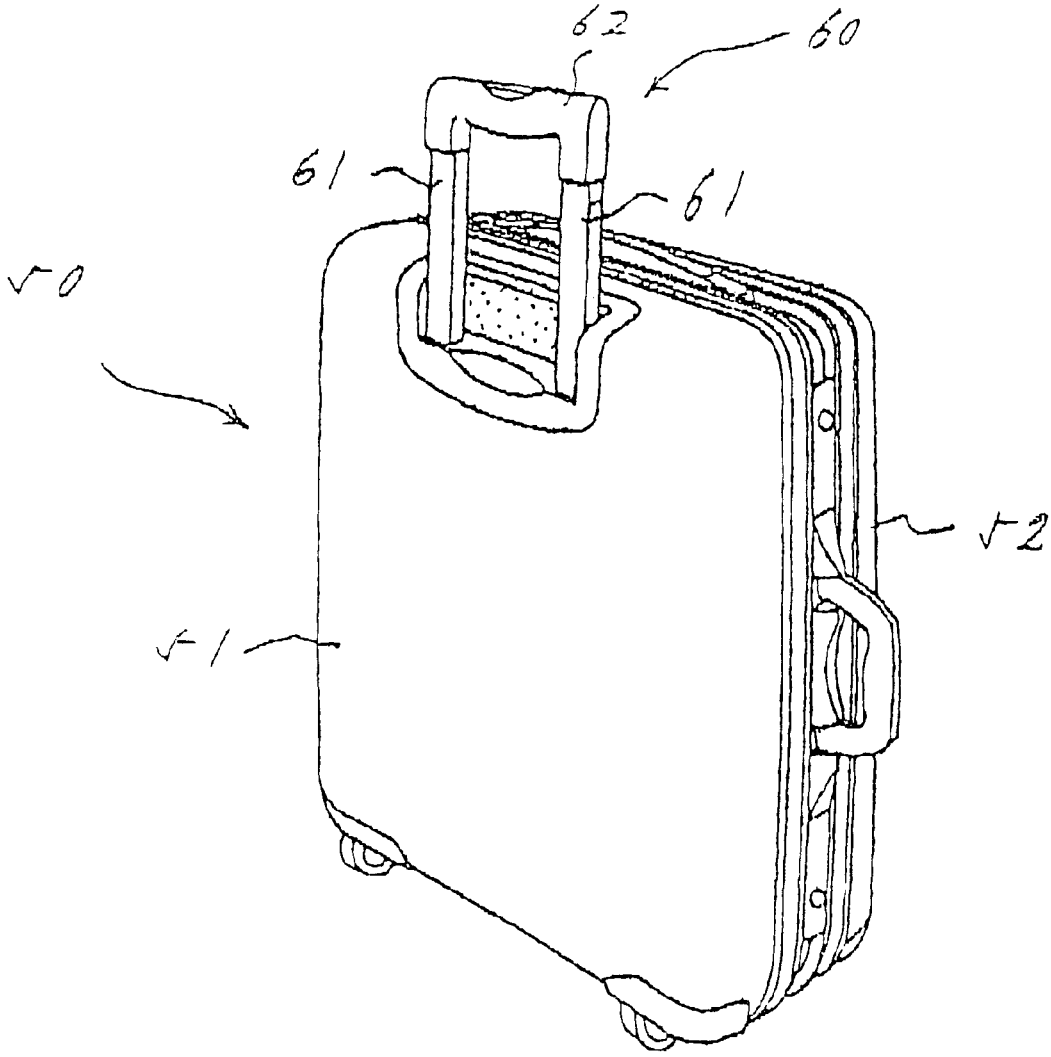
FIG. 4 PRIOR ART
FIG. 4 shows a conventional suitcase in which the handles are halfway extracted from the storage tubes.

The difference between the example of the shape of the suitcase according to this invention and the usual suitcase 50 as shown in FIG. 3 and FIG. 4 lies in the length of the storage tube 63 of the rods 61 and their fixture construction.

Figure 1:
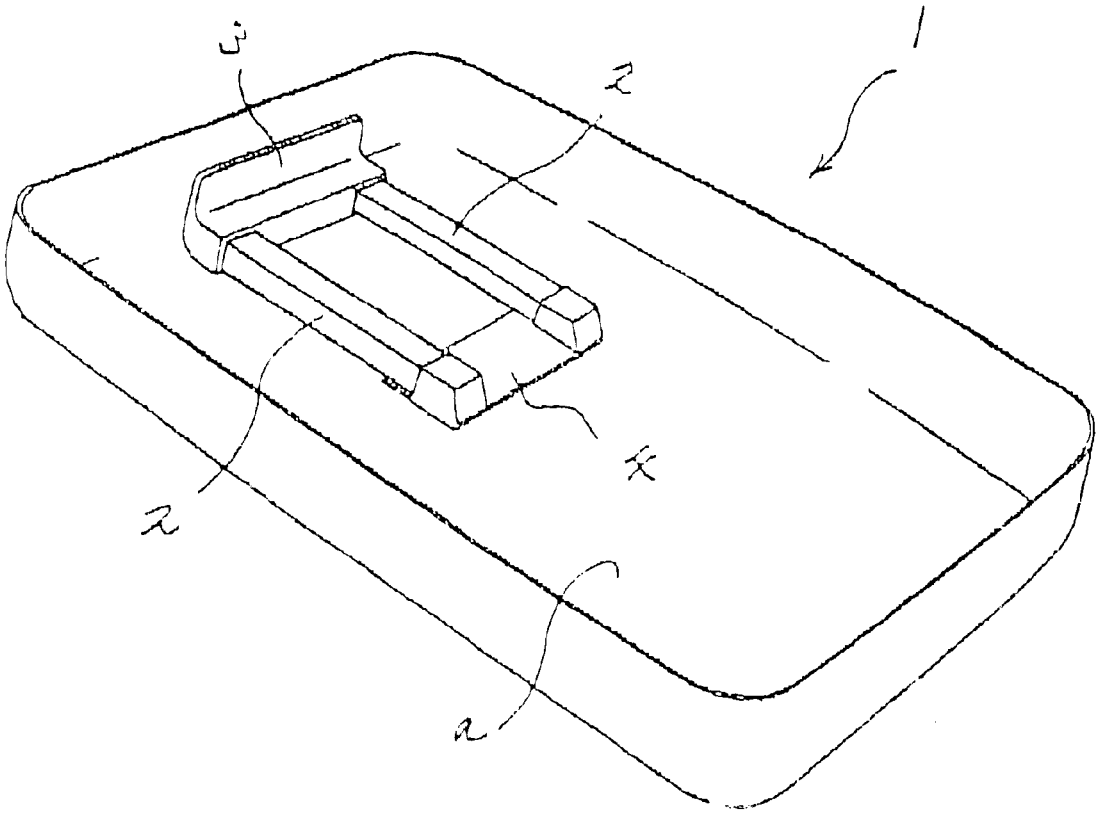
FIG. 1 is a side view of the body part of the suitcase of the present invention as viewed from the inside.

As shown in FIG. 1, at the base wall α (suitcase wall) of the body part 1 of the example suitcase shape the two storage tubes 2 are set parallel in a fixed distance from each other along the longitude part.

As for the length of the storage tubes 2, the limit of shortness is that the handle rods can be completely accommodated while at the same time a secure grip has to be ensured when the handle is fully extracted.

The storage tubes in the example are metallic; their length is less than half of the base wall of body part 1.

A good length measurement of the storage tubes 2 is of course also dependent on the size of the suitcase and the height of the user but should be set at between ⅔ and ⅓ of the length of the base wall.

As for the storage tubes 2, their upper ends (in the illustration on the left side) are both inserted into the insert holes 3*a*, which are located in the fixture part 3 of the upper part of base wall α where screw stops are adhered.

Also the lower part of the storage tubes 2 is on both sides inserted into an insert hole (abbreviated in the figure) which is located on the lower in fixture part 4 that is mounted onto the middle of base wall α.

The lower fixture part 4 is located in order to perform accurately and fast. In the completed form of the formed synthetic resin body part 1 (abbreviated in the figure) the mark to decide this location protrudes from the spot corresponding to the fixture location of the lower fixture part 4.

Figure 2:
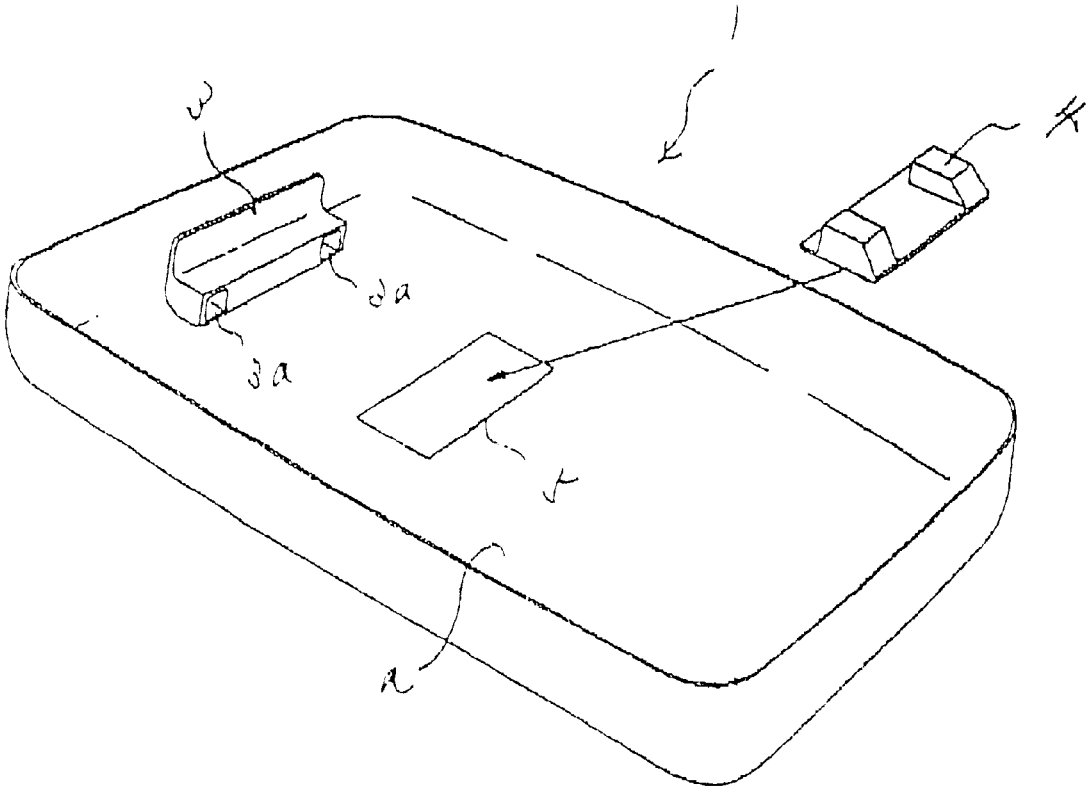
FIG. 2 is a side view showing the lower portion of the storage tubes as fixed onto the body part of the suitcase.

Therefore as shown in FIG. 2, as for the lower fixture part 4 the mark 5 of the location is made into a concave shape at the base wall a of body part 1.

So the lower fixture part 4 can be operated extremely easily and fast when accurately fixed into the decided location of base wall α.

Details of the structure of the above mentioned application example can also be modified into other suitable designs.

If needed in the body part α the thickness of neighboring areas of lower fixture part 4 be partly increased, also the installation of enforcement ribs is possible. It is also possible to complete the storage tubes 2 and the lower fixture part 4 (and the upper fixture part 3) with synthetic resin material at the same time.

As clearly shown in the above explanation, a suitcase handle fixture construction according to this invention, where the length of the handle rods that can be stored in tie storage tubes is as short as possible, shows superior efficiency in practical use, as stated below.

(a) When compared to usual suitcases, the storage tubes are made smaller, a reduction of the suitcase weight as well as a cut in material costs can be achieved.

(b) Compared to suitcases of synthetic resin material, the metal storage tubes are rather heavy, therefore making the whole construction lighter is very desirable for a suitcase.

(c) By shortening the length of the storage tubes, the effective inside storage space of the suitcase is increased.

(d) By the pre-installed mark for positioning in the body part, the lower fixture part can perform accurately and fast

What is claimed is:

1. A suitcase handle fixture construction comprising:

a suitcase having a wall with a length dimension and a width dimension, said wall having a mark molded thereon so as to protrude therefrom, said mark having a generally rectangular shape, said mark positioned between ⅓ and ⅔ of said length dimension from an upper end of said wall; a lower fixture part affixed to said mark on said wall, said lower fixture part having a first insert hole and a second insert hole formed therein;

an upper fixture part positioned at said upper end of said wall, said upper fixture part having a first insert hole and a second insert hole formed therein and facing said lower fixture part;

a first storage tube affixed within said first insert hole of said lower fixture part and within said first insert hole of said upper fixture part;

a second storage tube affixed within said second insert hole of said lower fixture part and within said second insert hole of said upper fixture part, each of said first and second storage tubes having a length which is between ⅓ and ⅔ of one of said length dimension and said width dimension, said upper fixture part and said lower fixture part and said first and second storage tubes positioned interior of said suitcase; and a retractable handle having a first rod slidably received within said first storage tube and a second rod slidably received within said second storage tube, said retractable handle having a cross bar connected to and extending between a top end of said first and second rods, said retractable handle movable between a position in which said cross bar is adjacent said top end of said wall and a position in which said cross bar is located outwardly of said top end of said wall.

2. The construction of claim 1, said mark being of concave shape.

3. The construction of claim 1, said lower fixture part having a generally rectangular surface positioned against said mark.

* * * * *